US005926870A

United States Patent [19]

Branca-Barnes et al.

[11] Patent Number: 5,926,870

[45] Date of Patent: Jul. 27, 1999

[54] SAFETY BED FOR CHILDREN WITH SPECIAL NEEDS

[76] Inventors: Patti Ann Branca-Barnes, 466 King St.; David George Stramiello, 437 West St., both of Port Chester, N.Y. 10573

[21] Appl. No.: 09/039,287

[22] Filed: Mar. 12, 1998

[51] Int. Cl.[6] ..... A47D 7/02

[52] U.S. Cl. ..... 5/93.1; 5/100; 5/430

[58] Field of Search ..... 5/93.1, 100, 424, 5/428, 429, 430

[56] References Cited

U.S. PATENT DOCUMENTS

| | | | |
|---|---|---|---|
| 2,011,909 | 8/1935 | Rece | 5/100 |
| 2,455,340 | 11/1948 | Newman | 5/100 X |
| 2,524,483 | 10/1950 | Shealey | 5/100 X |
| 2,889,560 | 6/1959 | Carman | 5/93.1 X |
| 3,069,700 | 12/1962 | Berlin | 5/100 |
| 3,879,773 | 4/1975 | Spencer | 5/100 |
| 4,715,075 | 12/1987 | Shamie | 5/93.1 |
| 4,953,246 | 9/1990 | Matthews | 5/424 |
| 4,959,878 | 10/1990 | Essek | 5/425 X |
| 5,077,846 | 1/1992 | Wheeler, III et al. | 5/93.1 X |
| 5,384,925 | 1/1995 | Vail | 5/424 |

*Primary Examiner*—Michael F. Trettel
*Attorney, Agent, or Firm*—Richard T. Holzmann

[57] ABSTRACT

A crib-like twin-size bed for disabled children with special needs having unusually high end and side panels, the one, or both, side panels being a combination fold-down plus slide-down side panel hinged together for permitting servicing of the bedding and the child by folding down the top panel while allowing convenient egress and ingress of the child into and out-of a wheelchair as necessary by sliding down the bottom panel.

10 Claims, 7 Drawing Sheets

SAFETY BED FOR CHILDREN WITH SPECIAL NEEDS

FIELD OF THE INVENTION

This invention relates to a safety bed and particularly one for children who are disabled and cannot care for themselves.

BACKGROUND

Since a home environment is oftentimes more conducive to care and convalescense than a hospital, many invalids today are being cared for at home. In addition, the cost of long-term hospital or hospice care is extremely expensive and is ordinarily unavailable to the average person. Besides, the loving care of a relative can be far more therapeutic than that of a stranger even though a highly professional one.

However advantageous such home care may be, there are a number of problems which place the home care option at a disadvantage to other options such as hospitalization and nursing home placement. One problem of particular importance is associated with a patient who may be prone to either falling out of bed accidentally or deliberately leaving the bed when he or she is supposed to remain bedridden. Such is the case when a child has a disease such as cerebal palsy, epilepsy, autism, and the like or is mentally retarded for whatever reason. A child patient who ought to remain in bed is especially vulnerable when not being carefully watched.

While conventional invalid beds have restraints such as straps and the like, and do restrict movement of the patient, these straps are difficult to apply especially if the patient resists restraint. Perhaps more importantly, they often produce bed sores and are neither a compassionate nor optimum solution to the problem.

While many available hospital beds have some sort of railings to prevent egress from a bed, they are primarily intended to prevent a patient from accidentally falling out and are inadequate to prevent a patient who is physically capable of leaving the bed if he or she chooses to do so. These hospital beds while longer than a child's crib have low railings with wide spaces between the bars. A child might easily roll out of this bed and if he or she stood up could readily tumble or flip over onto the floor. The portable side rails that fit under a standard mattress are approximately 12 inches high; these might prevent a child from rolling out over the sides but not at the head or foot of the bed. Furthermore, there exists the possibility of the child rolling between the mattress and the rails thus making them unsuitable for the intended purpose.

The most relevant prior art is probably the special invalid bed disclosed in U.S. Pat. No. 4,959,878 granted to Essek. This bed of a monolithic one-piece construction is designed for an adult patient with no movable railings and high side bars to prevent egress. The bed is sized for a twin mattress with storage area underneath. Instead of movable railings, it has a lockable door about 30 inches wide for entrance and exit. The disclosure is explicit in its objective to avoid movable railings which are held to be intended primarily to prevent a patient from accidentally falling out and are inadequate to restrain an adult patient if that patient is physically capable of getting out of the bed. These characteristics however, are ill-suited to restrain and service a multiply-disabled or medically needy child for example. There is therefore a requirement for a safety bed for children wih special needs.

It is a main object of the present invention to provide a crib-like safety bed for a disabled child that will fit a twin-size mattress and has a double fold-down railing on either one or both sides.

It is another object to provide this bed with rails high enough to prevent not only falling out but climbing out.

It is a further object to provide a bed wherein a swing-down panel is sufficient to allow for comfortable servicing of the child such as medicating, taking vital signs, washing and diaper changing.

It is yet another object to provide a bed wherein a slide-down panel will allow both railings to be lowered to mattress level in order to permit easy changing of bedding while permitting ready ingress and egress of the patient from and into a wheelchair.

It is another object to provide a bed with space and/or drawers underneath for storage of linen, bedding and diapers for example.

It is another object of the invention to provide a bed of wooden construction which can be blended in with the appearance of other furniture providing a home-like atmosphere being more congenial to a caring and healing environment.

SUMMARY OF THE INVENTION

According to the teaching of one embodiment of the present invention, as characterized in products manufactured thereby, is an invalid child's safety bed comprising: four L-shaped upright corner posts for supporting a main frame, including panel guide slots therein for mounting angles and guide bars at the inside corners thereof, the posts being positioned in a vertical orientation on a floor to define a rectangular space therebetween; four panels of equal width and equal height having top and bottom rails and bars therebetween, each of two panels connected to each other by a hinge and to two of the posts enclosing said rectangular space, each side of the bed including an upper swing-out panel having a top rail wherein is a lock set allowing swinging out and down 180° therefrom and a bottom rail having said hinge attached thereto, and each side of the bed including a lower slide-down panel having a top rail attached to said hinge and a bottom rail with a panel locking clip attached thereto said panel locking clip in movable contact with a foot lever; two narrower end panels of equal length for the head and foot of the bed, having top and bottom rails and bars therebetween; and a rectangular metal mattress frame for supporting a mattress support and a mattress of twin bed size, having a plurality of cross members with angle iron braces fixed to the sides thereof and channel irons to the ends thereof for receiving said cross members therein, being placed within said rectangular space at a low level near a floor and said angle iron braces being attached to the posts.

There are two primary features in this bed which are not found in conventional beds for children: 1) a swing-out and slide-down panel on one or both sides, and 2) an unusual overall height of about thirty-six inches for the sides and the head and foot panels. This provides the ease of ingress and egress from and into a wheelchair as well as protection of the child.

In a preferred embodiment, the posts and panels are made of wood to allow a commonality of design with other furniture in a room. However, it can also be constructed of plastic or metal if desired. In a typical embodiment, there is adequate space underneath for a plurality of drawers for the storage of selected items.

These and other features of the invention will be more clearly understood and recognized upon considering the detailed description which follows.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Experience has shown that conventional hospital or other beds do not provide an adequate level of safety for the child with special needs as pointed out above. The present invention avoids these problems by providing a bed having unusually high panels. Moreover, either one or both sides have two panels hinged together, one above the other which can be folded or slid down to allow servicing of the child, and to allow entering and exiting even directly from a wheelchair if necessary. The preferred embodiment is designed to accommodate a twin-sized matress. Nevertheless, a larger mattress of full, queen or even king-size is contemplated in order to provide a substantial play area for the child.

Figure 1:
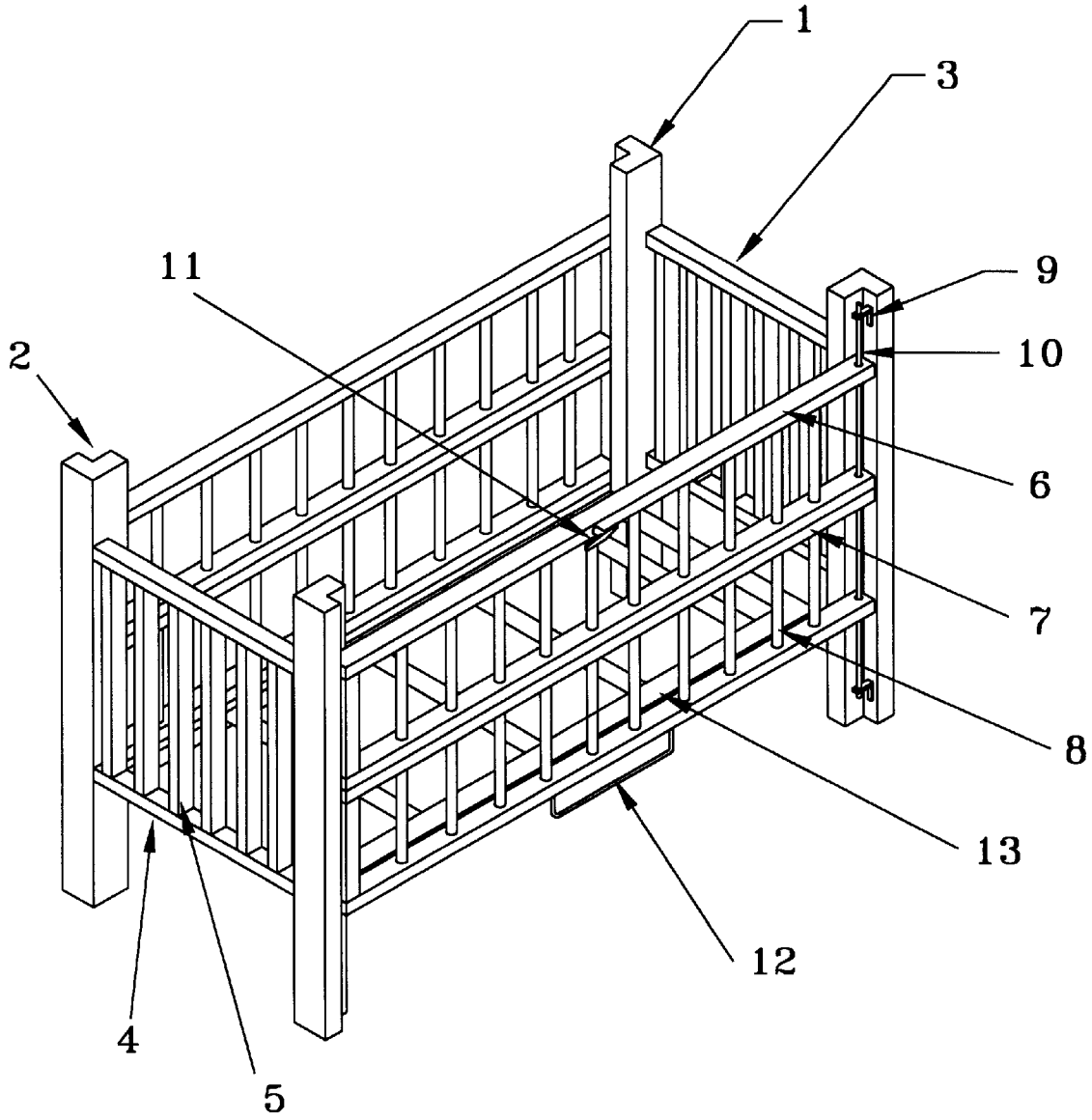
FIG. 1 is an isometric view of the bed.
Figure 2:
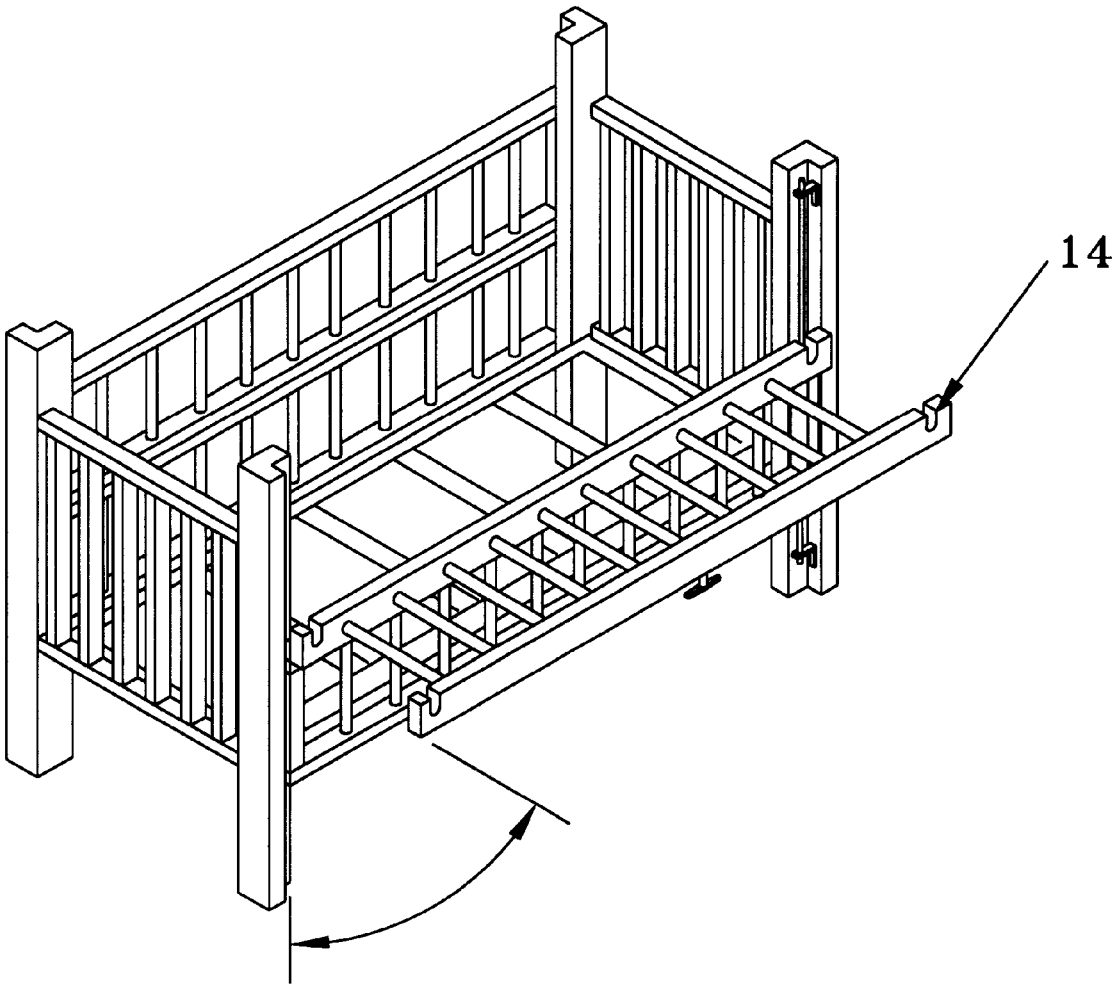
FIG. 2 is an isometric view of the bed with the swing-down panel down 90°.
Figure 3:
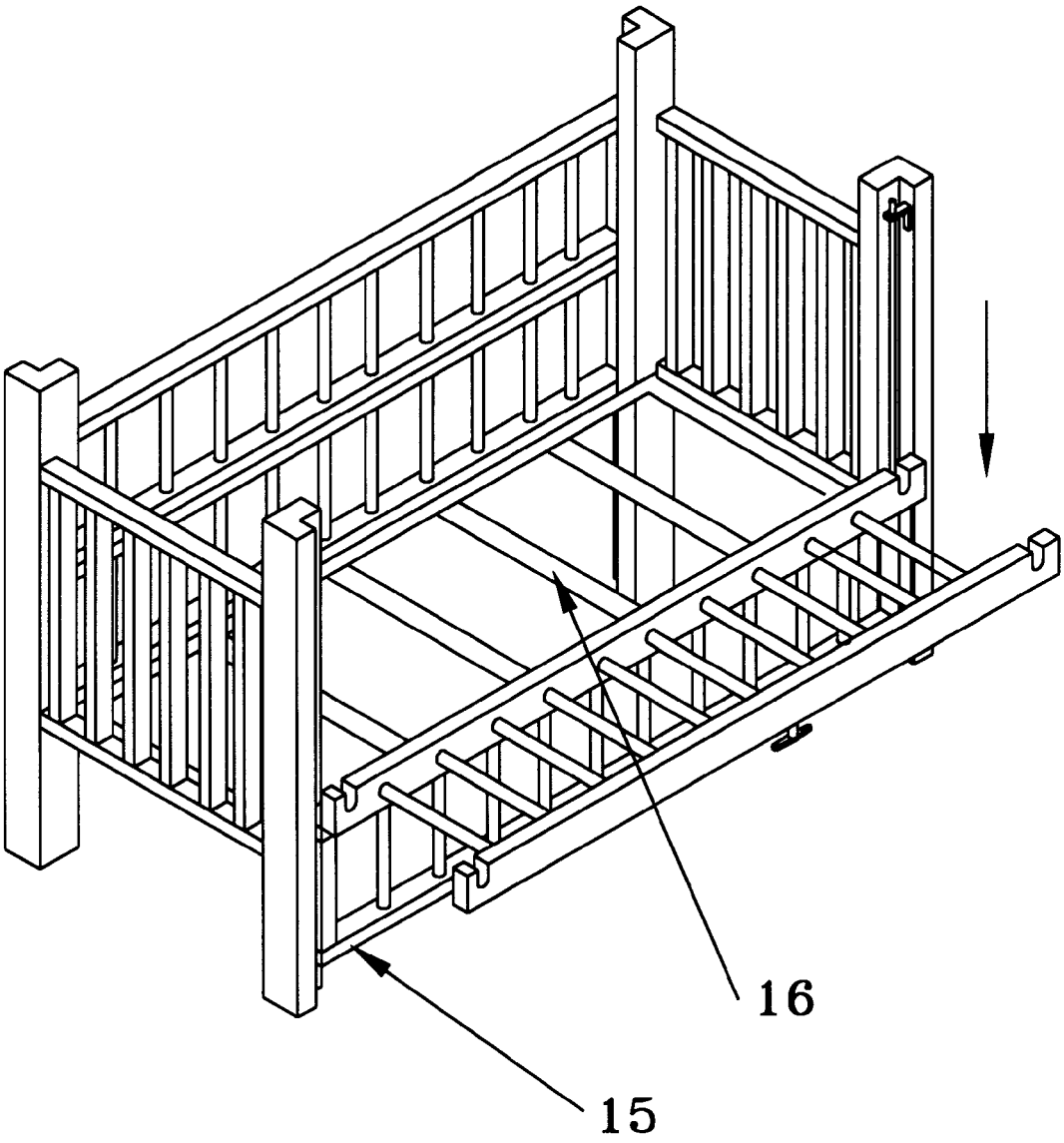
FIG. 3 is an isometric view of the bed with the swing-down panel down 90° and the slide down panel down.
Figure 4:
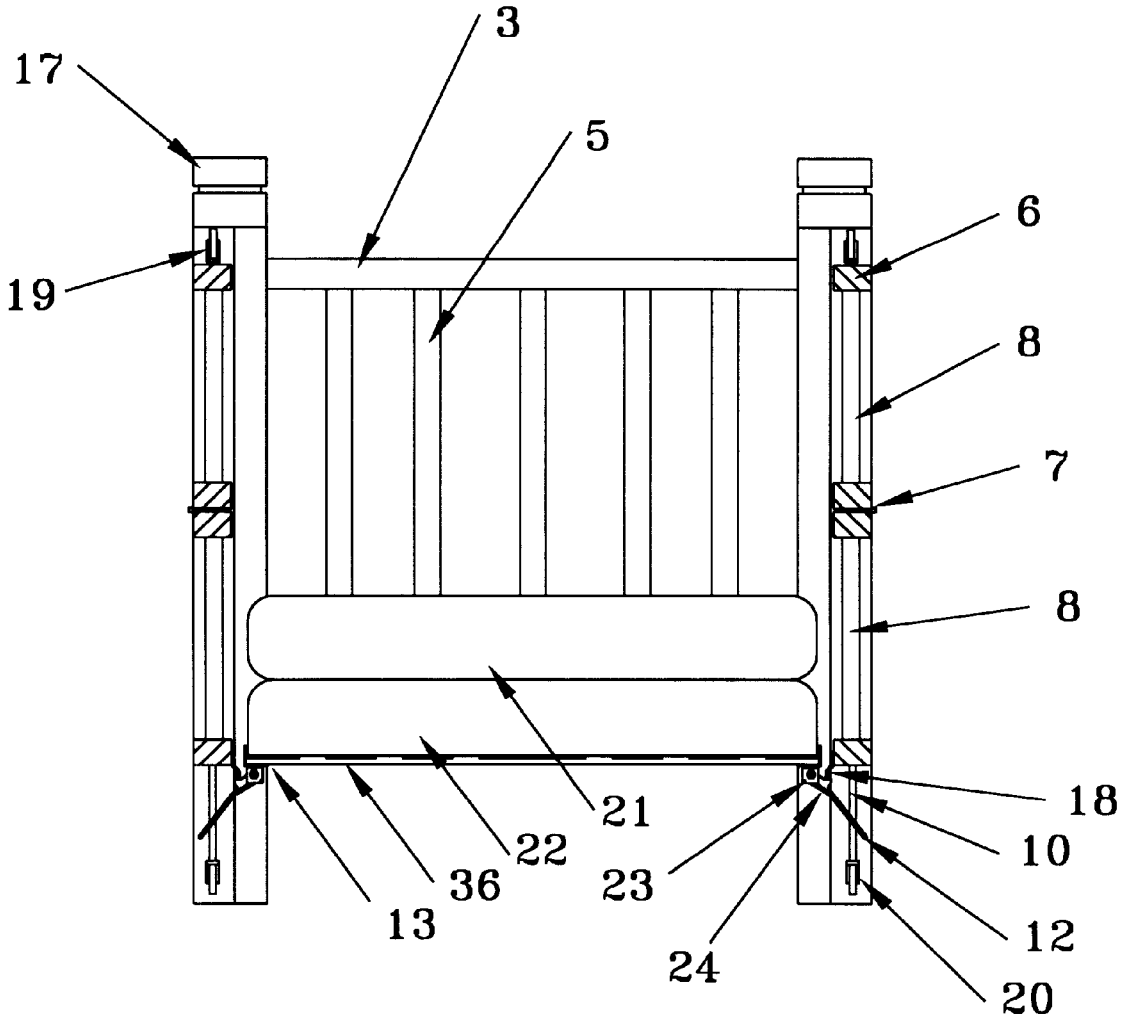
FIG. 4 is a cross-sectional view from an end of the bed.
Figure 5:
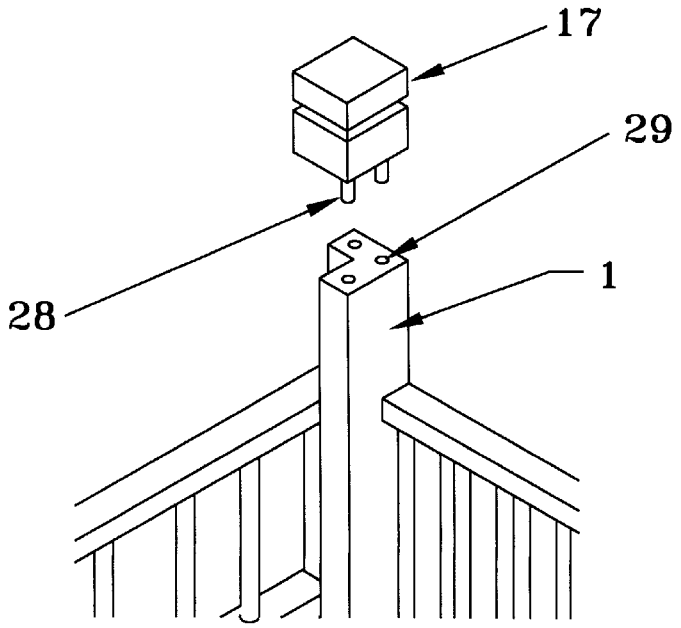
FIG. 5 is a detailed view of the bottom of the slide-down panel in conjunction with the foot lever assembly.

According to the preferred embodiment of the instant invention, all elements of the construction are wooden, with the exception of hardware of course, beginning with the four posts (1). Isometric views of the assembled bed are shown in FIGS. 1, 2, and 3. The posts (1) optionally may have decorative post heads (17) as shown in FIGS. 4 and 5. The posts (1) having panel guide slots (2) therein running their entire length are for placement of side panels by attachment of mounting angles (9) having a hole therein at the lower and upper ends thereof as shown in FIG. 1 for receiving guide rods (10). These mounting angles (9) may be attached to the guide slots (2) by any conventional means such as screws, bolts, brackets and the like although screws are preferred. The guide rods (10) are held in place by using top (19) and bottom (20) rod mounting clips as shown in FIG. 4.

The two end panels have top (3) and bottom (4) rails and bars (5), these latter connecting the rails together to form the panels and the panels are fixed, preferably by screws, to the inside of the posts (1) opposite the panel guide slots (2). The width of the end and side panels are selected to provide a rectangular space adequate to allow insertion of a typical twin size mattress (21) and lower mattress, spring or board-like support (22) to be placed on a metal frame mattress support (13) as seen in FIG. 4. Although the preferred embodiment utilizes end panels having bars and rails, in an alternative construction, these end panels may be solid (not shown), i.e., absent rails and bars.

Figure 6:
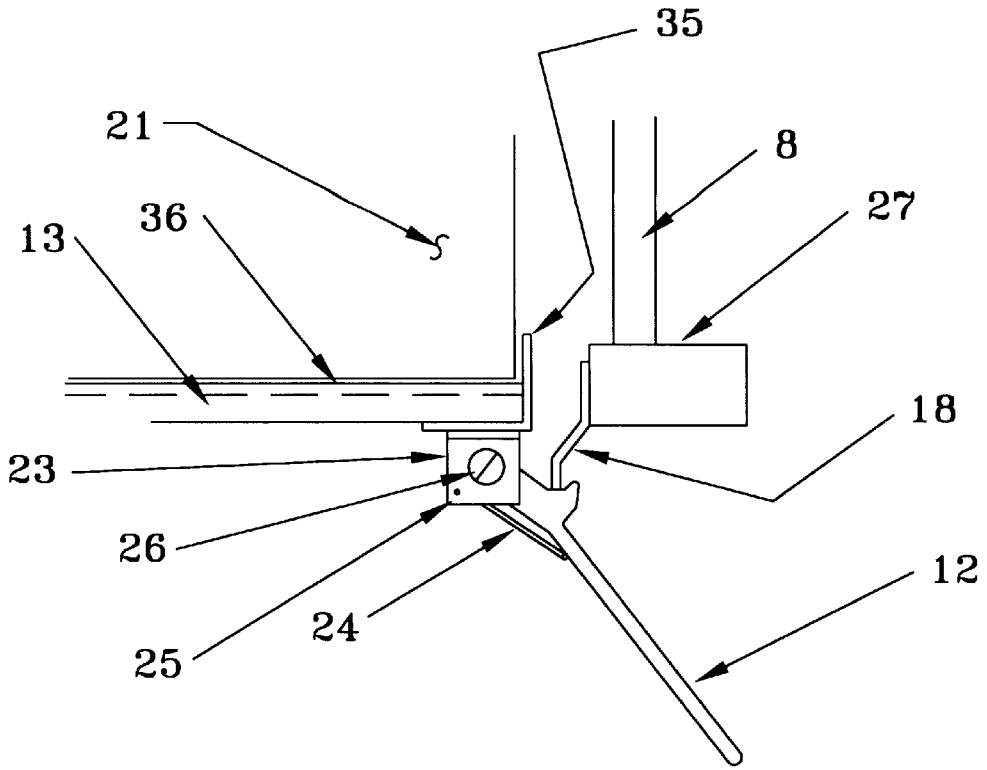
FIG. 6 is an exploded view of the decorative post head.

The metal frame mattress support (13) has metal cross members (16) as shown in FIGS. 2 and 3 running either parallel to the length or perpendicular thereto, as well as angle irons (35) running completely around the metal support (13) and welded thereto, these latter illustrated in FIG. 6, for fastening to the posts (1) by conventional means. In addition, channel irons (36) are also welded to the metal mattress support (13) to seat the cross members (16) indicated in FIG. 6.

Figure 7:
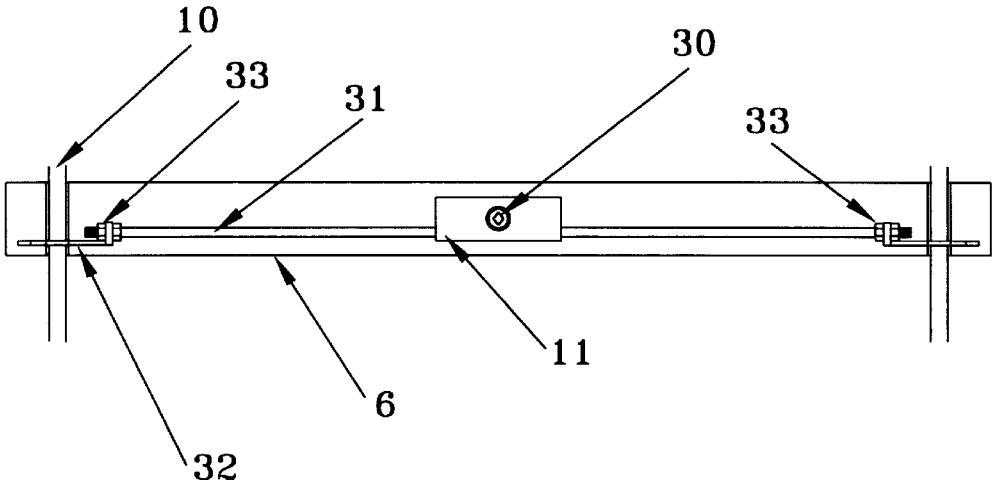
FIG. 7 is a cut-away side view of the lock-set assembly.
Figure 8:
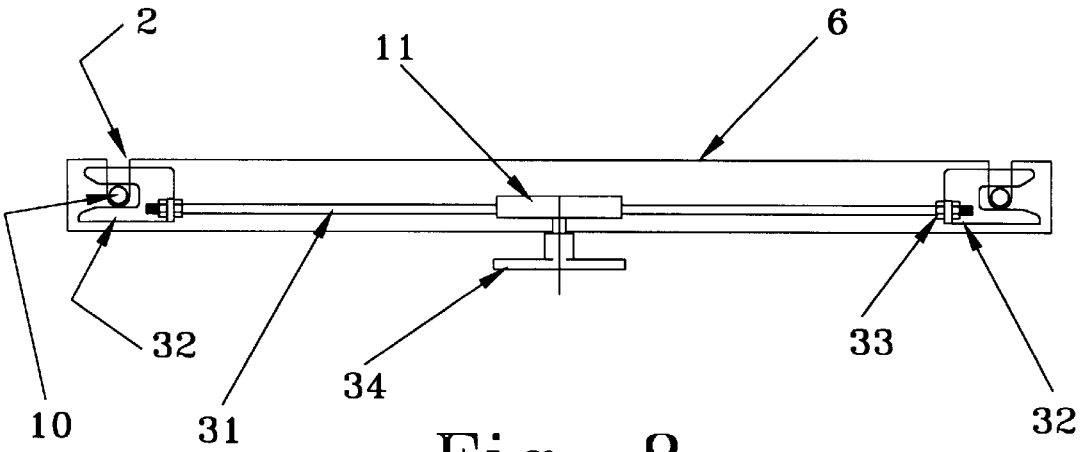
FIG. 8 is a cut-away top view of the lock-set assembly.

As can be seen in FIG. 1, the top rail (6) of the swing-out panel includes a lock-set (11), more clearly described in FIGS. 7 and 8, as well as having two slots (14) therein as shown in FIG. 2 for receiving guide rods (10), for preventing a child from falling or climbing out of the bed while at the same time allowing a caretaker more ready access to the child while still in the bed. Also in FIG. 1 is a foot lever (12) placed generally in the center of the side panel area shown in more detail in FIG. 6, which is in contact with the bottom rail (27) of sliding panel (15) having bars (8) as seen in FIG. 3, through panel locking clips (18) as seen in detail in FIG. 6. The bottom rail of the swing-out panel has a hinge (7) thereon joined with the top rail of the sliding panel (15) allowing the swing-out panel to fold down a full 180° as seen in FIG. 2 although only a 90° drop is shown.

FIG. 4 is a cross-sectional view from an end of the bed showing the mattress (21) in place above another mattress (22) which may also be a spring or merely a board to support the mattress (21) resting on the metal frame mattress support (13). This view also illustrates the embodiment having movable panels on both sides of the bed. More clearly shown are top (19) and bottom (20) guide rod mounting clips which hold the guide rods (10) in a fixed position supported by the mounting angles (9) attached to the posts (1). While the foot lever (12) attached to the bottom rail (27) of sliding panel (15) is also shown in this figure, much more detail can be seen in FIG. 6.

FIG. 5 is an exploded view of the wooden decorative post head (17) with pins (28) as a part thereof for insertion into the top of the posts (1) having holes (29) therein for receiving the pins.

Turning to FIG. 6 one finds cross-sectional detail of the foot lever (12) mechanism which is in movable contact with a panel locking clip (18), said clip being screwed or otherwise fixed to the bottom rail (27) of sliding panel (15). Attached to the metal frame mattress support (13) is a foot lever assembly mounting clip (23) in which the foot lever (12) is movably held in place by rivet (26) allowing free movement of the foot lever (12) when the latter is depressed by foot pressure. As pressure is applied to foot lever (12), panel locking clips (18) are removed from the crook of foot lever (12) permitting lowering of sliding panel (15) as well as the unhinged swing-out panel attached thereto so that the top rail of the sliding panel (15) is at the same level with the bottom rail of the swing-out panel, becoming even with the top of the mattress (21) allowing for smooth transfer into a wheelchair or from a sitting to standing position on the floor. Foot lever (12) has a spring (24) attached to both ends thereof which are seated in hole (25) of the panel locking clips (18) holding the panels in place in the down position until such time as the panels are pulled-up allowing the spring (24) to force foot lever (12) back to its original position in contact with the two panel locking clips (18).

FIGS. 7 and 8 are respectively cut-away side and top views of the lock-set assembly which is enclosed in the top rail (6) of the swing-out panel to insure that inadvertent folding down of this panel with possible injury to the child does not occur. Top rail (6) is in two sections (not shown) which are bonded together after the lock-set assembly is assembled. The side view in FIG. 7 shows lock-set (11) having a T-handle key slot (30) therein for controlling movement of two rods (31) threaded at the ends having nuts (33) thereon for adjusting the effective length of stamping lock clips (32) in order to allow the stampings (32) to engage guide rods (10) for locking and unlocking the side panels. FIG. 8 shows more clearly the T-handle (34) of the lock-set (11). It should be noted that while a T-handle is illustrated in the drawings and is acceptable, a pinch-squeeze latch (not shown) has proven to be superior.

Upon actuating the lock assembly from the unlocked position, rods (31) are moved outward engaging stampings (32) with guide rods (10) locking the top panel in place preventing it from accidentally falling down. The reverse operation retracts stampings (32) permitting swing-down of the top side panel. Then, by applying pressure to foot lever (12), panel locking clips (18) are freed from contact therewith lowering the side panel to its lowermost position. Pulling the side panel up allows the foot lever (12) to spring back to its original position in contact with both panel locking clips (18).

In an alternative embodiment of the present invention, conventional wheels (not shown) are affixed to the bottom of posts (1) to allow movement of the bed to different locations in the room or from room-to-room. These wheels can also permit easy movement of the bed with a side panel down to a position alongside of the parent's or other caregiver's bed to allow the child to crawl or roll into the larger bed should that be desired. In such case, the child's bed can be adapted to have the top of the mattress (21) level with that of the larger bed to facilitate this transfer.

Figure 9:
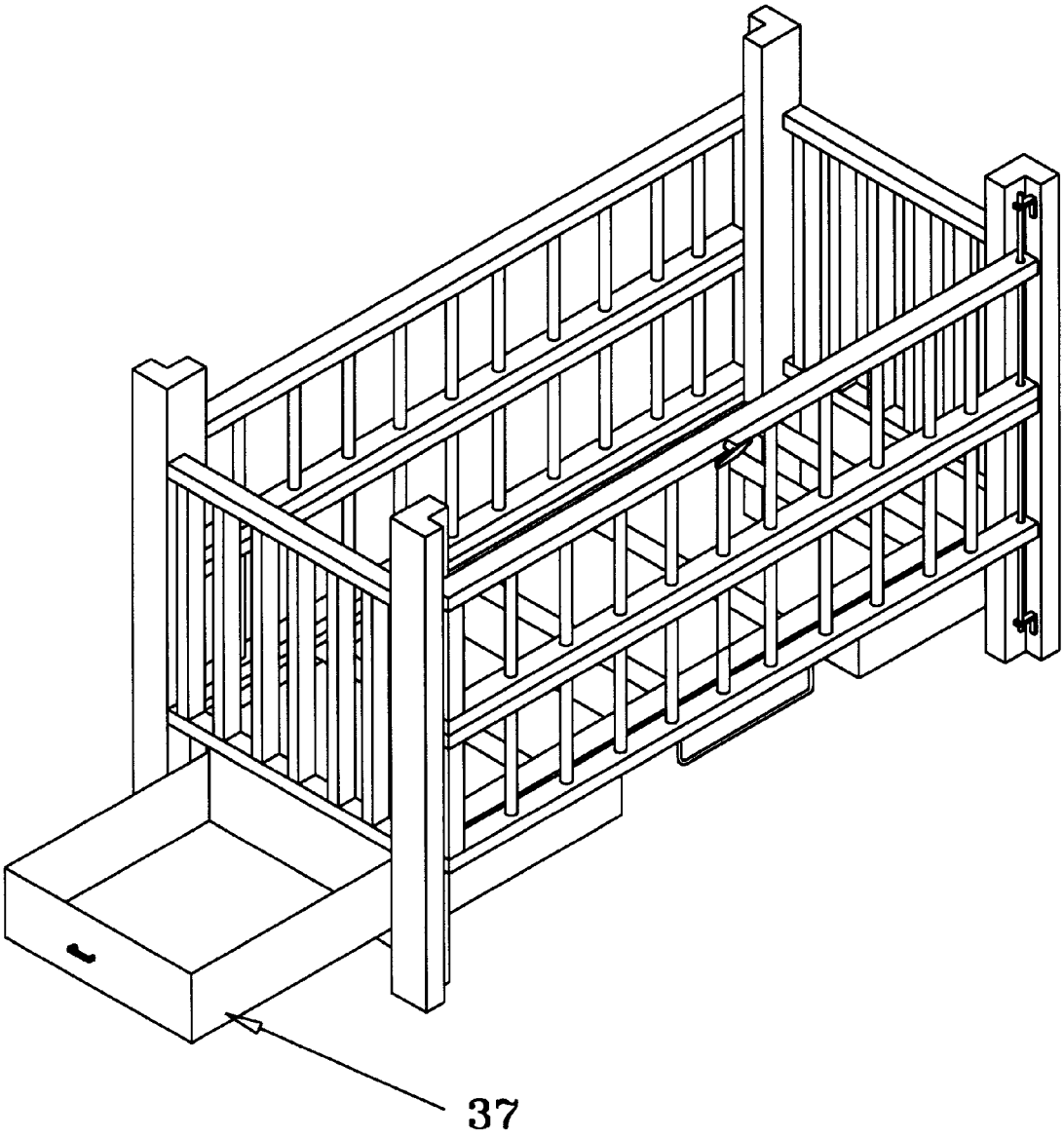
FIG. 9 is an isometric view of the bed with drawers in place.

In another alternative embodiment of the instant invention, conventional drawers (37) shown in FIG. 9, usually two in number, may be installed under the bed to provide storage space for linens, other bedding, diapers, and the like. In such a preferred arrangement, the drawers (37) having male tracks on their top sides are fitted to a framework attached to the posts (1) having female tracks to receive the drawer tracks for opening and closing. A space between the drawers is wide enough to allow operation of the foot lever assembly.

While the preferred materials of construction for the bed are made of wood for the reasons given above, other materials such as plastic, aluminum, steel, and other metals may also be employed. Whatever the material, it should have a washable finish due to the nature of its usage.

The best mode contemplated by the invention for assembly of the safety bed for children according to the present invention as a first step requires fixing each end panel, already assembled, to two of the posts (1) having the mounting angles (9) mounted on the posts to be used for the movable panels only thereon. Using this approach, the one non-movable assembled side panel, is attached to the two posts having no mounting angles thereon defining three sides of the rectangular space. The metal frame mattress support with its angle (35) and channel (36) irons already in place is then fixed to all four posts.

The foot lever assemblies are preassembled, as shown in FIG. 6, and fixed to the metal frame mattress support (13) allowing it to be placed in movable contact with the panel locking clip (18) of the top and bottom panel combination when the latter is in the up position. It should be noted that the foot lever assemblies are in reality two similar assemblies, only one being shown in the drawings, on either end of foot lever (12) for movable contact with the two panel locking clips (18), again, only one is shown in the drawings.

The open side of the thus partially assembled bed is next fitted with the preassembled movable side. This preassembled side consists of the top and bottom panels hinged together with the lock-set (11) installed in the top rail (6) of the top panel. To the bottom rail (27) of the bottom panel (15) is fixed the panel locking clip (18) so that when installed in place it will come into movable contact with the foot lever (12) of the foot lever assembly already attached to the metal frame mattress support (13).

To operate the movable side panels in normal usage, the lock-set (11) in the top panel is unlocked and the panel is swung-down 180° lying alongside the bottom panel. Foot lever (12) is then depressed against the tension of spring (24) after raising the panels slightly to free the panel locking clip (18) from contact with the foot lever (12) for lowering the movable panels to the lowermost position resting against the lower mounting angles (9). Merely raising the side panel combination reverses the process causing depressed spring (24) to force the foot lever (12) back into movable contact with panel locking clip (18). It should be emphasized that this foot lever assembly mechanism is conventional in the art.

The refinement introduced by the instant invention then is to provide for children with special needs, a twin-size, or larger, safety bed with unusually high end and side panels to prevent accidental or intentional rolling, falling or tossing out of the bed onto the floor. At the same time, this effect allows convenient servicing of the child and the bedding. In addition, it provides capability for allowing convenient ingress and egress from and into a wheelchair.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An invalid child's safety bed comprising:

four L-shaped upright corner posts for supporting a main frame, including panel guide slots therein for mounting angles and guide bars at inside corners thereof, the posts being positioned in a vertical orientation on a floor to define a rectangular space therebetween;

four panels of equal width and equal height having top and bottom rails and bars therebetween, each of two panels connected to each other by a hinge and to two of the posts enclosing said rectangular space to form each side of the bed, each side including an upper sting-out panel having a top rail with is a lock set assembly that allows the swing-out panel to swing out and down 180° relative to the side, and a bottom rail having said hinge attached thereto, and each side of the bed including a lower slide-down panel having a top rail attached to said hinge and a bottom rail with a panel locking clip attached thereto said panel locking clip in movable contact with a foot lever;

two narrower end panels of equal length for the head and foot of the bed, having top and bottom rails and bars therebetween; and a rectangular metal mattress frame support for supporting a mattress, having a plurality of cross members with angle iron braces fixed to the sides thereof and channel irons to the ends thereof for receiving said cross members therein, being placed within said rectangular space at a low level near a floor and said angle iron braces being attached to the posts.

2. The safety bed according to claim 1 wherein one side of the bed has movable panels and the other side has a one-piece rigid side panel, and both ends of the bed are of one-piece rigid construction.

3. The safety bed according to claim 1 wherein said swing-out panel has slots in the top and bottom rails thereof for enclosing said guide bars interconnected to said mounting angles through a top and bottom guide bar mounting clip to allow locking said swing-out panel in an upright position.

4. The safety bed according to claim 1 wherein said lock set further comprises a T-handle and a T-handle key slot, two rods having threads at one end for engaging nuts for adjusting effective length of stamping lock clips attached thereto for engaging said guide bars preventing said swing-down panel from swinging down.

5. The safety bed according to claim 1 wherein the foot lever in contact with said panel locking clip is a portion of a foot lever assembly further comprising a foot lever mounting clip attached to said angle iron brace of said metal frame mattress support, having a spring locking hole therein for receiving a spring for urging the foot lever fixed by a rivet in said panel locking clip to its original position when raising said sliding panel.

6. The safety bed according to claim 1 further comprising a decorative post head having a plurality of pins in the base thereof for insertion into the post top having corresponding holes therein for receiving said decorative post head.

7. The safety bed according to claim 1 wherein the posts and said panels are made of wood to allow a commonality of design with other furniture in a room.

8. The safety bed according to claim 1 having adequate space underneath further comprising a plurality of drawers for the storage of selected items.

9. The safety bed according to claim 1 wherein said top rail of said swing-out panel is comprised of two pieces bonded together after insertion of said lock-set assembly therebetween.

10. The safety bed according to claim 1 wherein said sides and end panels have an overall height of about thirty-six inches for protecting a child from falling, rolling or flipping out of the bed.

* * * * *